US005261533A

United States Patent [19]

Adams et al.

[11] Patent Number: 5,261,533

[45] Date of Patent: Nov. 16, 1993

[54] TAX-STAMPABLE HALF-CARTON

[75] Inventors: John M. Adams, Mechanicsville; Christopher N. Chance, Richmond; James A. DeBlasio, Midlothian; Donald H. Evers, Richmond; William C. Harris, Jr., Midlothian; Michael A. Kirby, Sr., Trevilians; Reginald W. Newsome, Richmond; Robert E. Talley, Chester, all of Va.

[73] Assignee: Philip Morris Inc., New York, N.Y.

[21] Appl. No.: 832,691

[22] Filed: Feb. 7, 1992

[51] Int. Cl.[5] ..... B65D 5/54

[52] U.S. Cl. ..... 206/261; 206/273; 229/120.09

[58] Field of Search ..... 206/271, 273, 274, 261, 206/256, 258, 242; 229/120.08, 120.09

[56] References Cited

U.S. PATENT DOCUMENTS

| | | | |
|---|---|---|---|
| Re. 19,029 | 12/1933 | Sugarman . | |
| 802,884 | 10/1905 | Purchas . | |
| 1,875,197 | 8/1932 | Molins . | |
| 2,959,338 | 11/1960 | Thurston | 229/120.09 |
| 3,092,301 | 6/1963 | Selle . | |
| 3,208,079 | 9/1965 | St. John | 229/120.08 X |
| 3,677,458 | 7/1972 | Gosling | 229/120.08 X |
| 4,256,223 | 3/1981 | Pawlowski | 229/120.08 X |
| 4,631,900 | 12/1986 | Mattei et al. . | |
| 4,928,817 | 5/1990 | Focke . | |
| 4,932,534 | 6/1990 | Focke et al. . | |

*Primary Examiner*—Steven N. Meyers
*Assistant Examiner*—Jacob K. Ackun, Jr.
*Attorney, Agent, or Firm*—Jeffrey M. Hersh

[57] ABSTRACT

A cigarette carton comprising two half-carton sections, each containing five cigarette packs, which may be sold as one standard ten-pack cigarette carton or may be separated and sold as individual half-cartons. The dual half-carton configuration permits the use of existing tax-stamping machines without any modifications. The dual half-carton unit is formed from a single blank and is detachably connected along a perforated line running along the top of the interior walls of each half-carton section, extending from one side wall to the other. Each half-carton section contains a top closure attached to the external hull that may be closed to encase the five cigarette packs in that half-carton section by tucking a tuck portion into the interior of the box along the inside of that half-carton section's interior wall. The top portion of the interior walls may be folded away from each half-carton section to which they are attached to create a space in which each tuck portion may be inserted.

24 Claims, 10 Drawing Sheets

TAX-STAMPABLE HALF-CARTON

BACKGROUND OF THE INVENTION

This invention relates to cigarette packages. More particularly, this invention relates to detachable paperboard double half-cartons for cigarette packs in which a dual half-carton is run through a standard tax-stamping machine and then may be separated for sale as separate, individual half-carton units.

Cigarettes are commonly sold in paperboard cartons of ten cigarette packs, each pack containing about twenty to twenty-five cigarettes. Due to the rising cost of standard cigarette cartons it has become desirable to make available to consumers half-cartons of five cigarette packs in addition to the standard 10-pack cartons.

Standard cigarette cartons contain two parallel rows of five packs in which the packs in each row are aligned side-by-side. In each row, the packs typically are positioned with the bottom of the pack facing upward and the sides adjacent to and touching each other.

Most states and some cities require that tax stamps be affixed to cigarette packs prior to sale. Because of this requirement, cigarette cartons are made without permanently sealing the top closures of the cartons, so that they may be opened then stamped as they are run through a tax-stamping machine, re-closed, then shipped to retail stores for sale to consumers.

Existing tax-stamping machines are geared for simultaneously stamping ten cigarette packs in the standard 2×5-pack configuration. Accordingly, to use existing tax-stamping machines, half-cartons must be configured in parallel pairs such that two half-cartons may be sent through a standard tax-stamping machine in one 2×5-pack unit. However, the two half-cartons must be held together securely, without slipping, to ensure that the tax-stamping machine will function correctly. In addition, the two half-cartons must not be too thick to pass between the vertical rollers of the tax-stamping machine.

It would be desirable to be able to provide a double half-carton for cigarette packs that may be run through a tax-stamping machine then may be separated into half-carton units. It would also be desirable to accomplish this without developing new technology or expensive retooling and modifications of existing carton-fabrication machines and procedures.

SUMMARY OF THE INVENTION

It is an object of this invention to provide an improved way of packaging cigarette packs into detachable half-cartons for use in existing tax-stamping machines and with minimal modifications to carton-fabrication machines and procedures.

It is another object of the present invention to make the detachable double half-carton from a single modified blank, preferably of paperboard. The blank may be folded around two sets of a designated quantity of cigarette packs, preferably five, to form two half-cartons sections. Each half-carton section has an interior and exterior wall, two side walls, a bottom wall and a top closure. The half-carton sections are detachably connected along the top of the adjacent interior walls of each half-carton.

It is yet another object of this invention to provide a fold line horizontally positioned along the interior wall of each half-carton such that when the interior walls of each half-carton are pulled away from each other the portion of the interior walls above the fold lines form an inverted-V. This facilitates fabrication of the dual half-carton by machine and the insertion and gluing of the top closures inside the carton after tax-stamping.

Another object of the present invention is to provide a modified top closure that may be folded back to permit tax-stamping on existing equipment then later tucked into each half-carton. In this way, the double half-carton unit may be separated into two distinct, fully enclosed half-carton units of, for example, five cigarette packs for retail sale to consumers. Alternately, the half-cartons may be separated after tax stamping and the top closure of each folded over and secured to the outside of the interior wall of the half-carton.

During the initial assembly process, after the dual half-cartons are formed into one dual-pack unit, preferably a 2×5 pack carton, the top closures are preferably temporarily closed by folding one flap over the top of both half-carton sections, then folding the other flap over the top of the first flap. The flaps may be secured closed by detachable securing means, which includes but is not limited to a releaseable glue, tape or other adhesive. The bottom of the half-carton sections may be secured by an adhesive strip or tape that is perforated or otherwise weakened along a line that separates the bottom walls of the two half-carton sections. The double half-carton unit is then ready for shipping and later tax stamping.

Alternately, the perforated tape or sticker may contain pricing indicia such as a uniform package coding (UPC) label that is readable by a scanning device when the tape or sticker is intact but not readable when broken in two as the half-cartons are separated. Each half-carton may further contain pricing indicia positioned on the abutted sides of the interior walls such that the pricing indicia is only readable after the half-cartons are separated.

Immediately prior to tax stamping, the temporarily closed top closures are opened and folded back to expose the bottoms of the cigarette packs. Each pack is then stamped. Once the cigarette packs are stamped, the top closures may be closed by pulling apart the two connected half-cartons and causing the top portion of the interior walls to pivot at the fold lines and forming an inverted-V, then by tucking the tuck portion of the top closure inside the half-carton section along the top of the interior side of the interior wall. Alternatively, the top closure may be secured by gluing the tuck portion to the exterior side of the top portion of the interior wall after the half-carton sections are separated into individual half-carton units.

It is a further object of the present invention to ship such enclosed double half-cartons to retailers for sale to consumers either in a double half-carton unit, preferably a 10-pack carton, or by breaking the perforated edges of the extension tabs and thereby separating it into two half-carton units, preferably two 5-pack units. The cigarette packs in each half-carton are preferably positioned such that the label or logo on the bottom of the packs may be read by a consumer who opens the top closure with the interior wall of the half-carton facing the consumer.

BRIEF DESCRIPTION OF THE DRAWINGS

The above and other objects and advantages of the present invention will be apparent upon consideration of the following detailed descriptions, taken in conjunction with the accompanying drawings, in which like reference characters refers to like parts throughout and in which:

FIG. 11 shows the dual half-carton configuration after separation into two fully enclosed half-carton units.

DETAILED DESCRIPTION OF THE INVENTION

There are two preferred embodiments of this invention, each with its own advantage. However, both embodiments employ the same basic inventive feature. Because of the substantial overlap of the two embodiments, each will be described concurrently.

The first embodiment is shown in FIGS. 1, 3, 5–9 and 11. The second embodiment is shown in FIGS. 2, 41 ∝ 8, 10 and 11.

Figure 1:
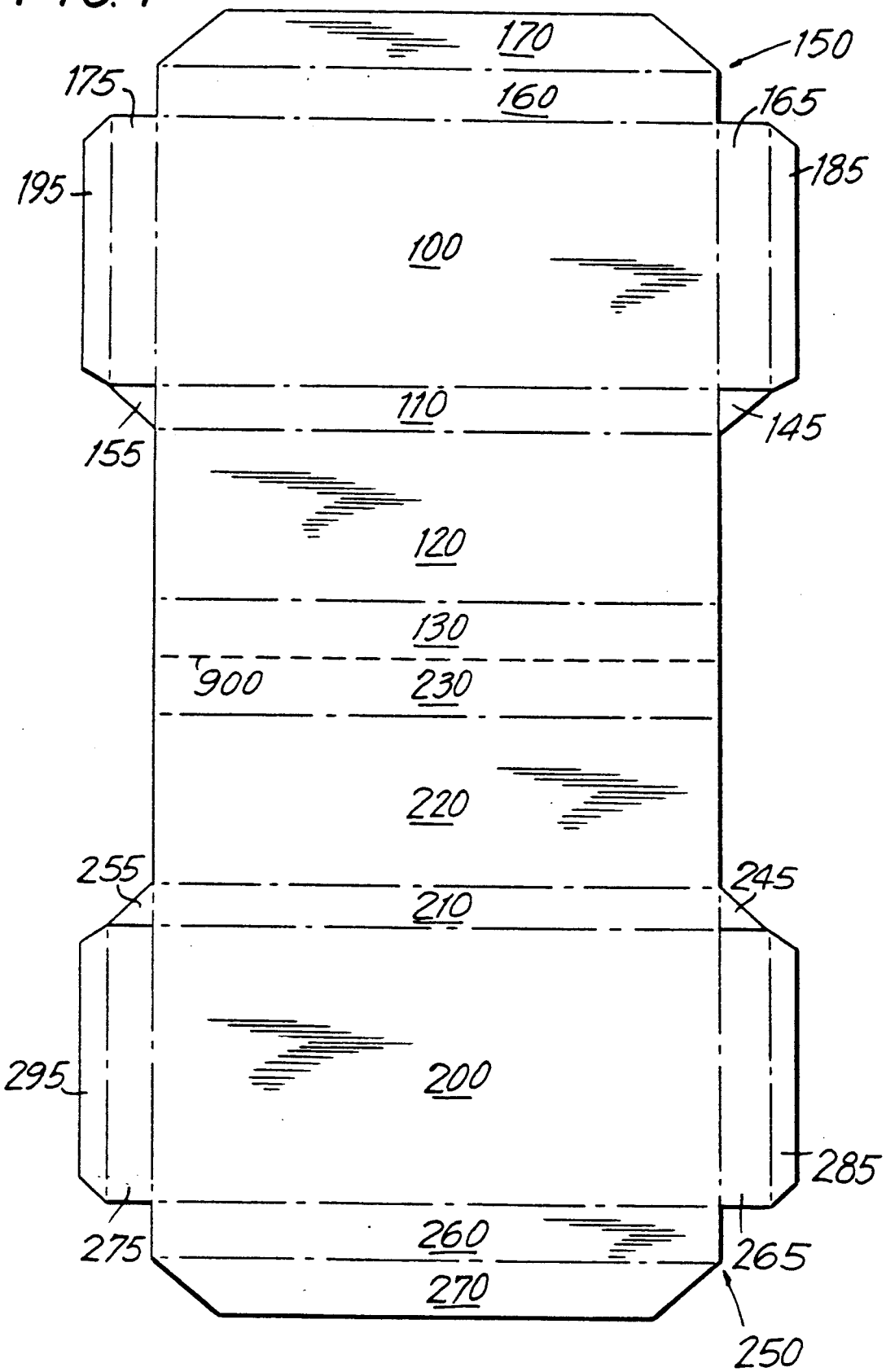
FIG. 1 is a first embodiment of a one-piece blank that forms a detachable dual half-carton.
Figure 2:
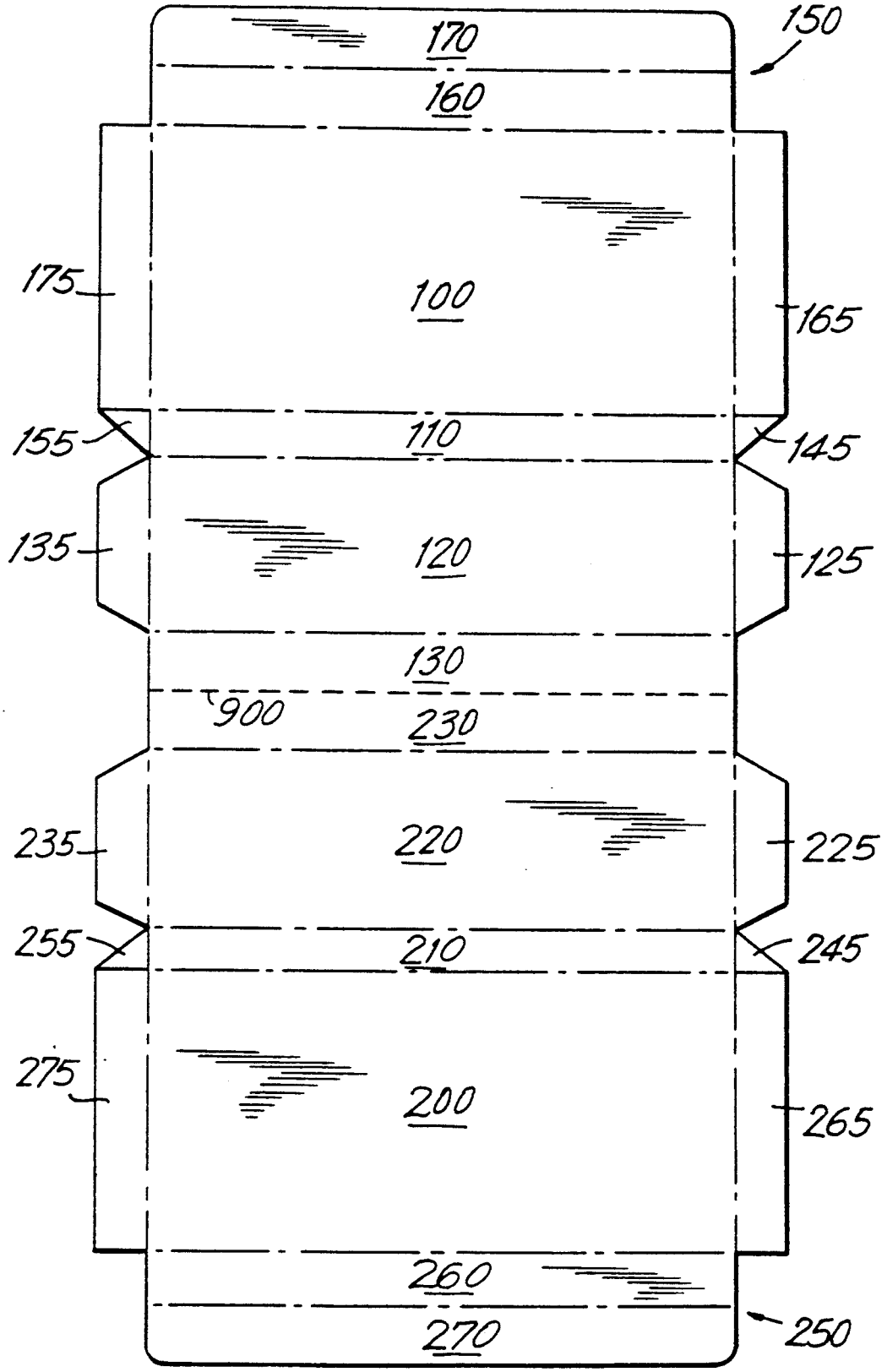
FIG. 2 is a second embodiment of a one-piece blank that forms a detachable dual half-carton.

In the preferred embodiments of the present invention, a blank of paperboard is fabricated as shown in FIGS. 1 and 2, each of which will ultimately form a detachable dual half-carton. The dashed lines containing alternating long and short dashes are fold lines or perforated scores along which the walls of the carton are folded to form the dual half-carton configuration. Perforated line 900, having only short dashes as shown in FIGS. 1 and 2, is a heavily perforated or scored line along which the dual half-carton configuration may be initially folded and later torn apart and separated.

The blank is folded along the fold lines and perforated line 900 to encase the cigarette packs, with half of the cigarette packs aligned side-by-side in each half-carton section of the dual half-carton configuration. Preferably, the blank will encase ten cigarette packs, five packs in each half-carton section. Those skilled in the art will appreciate that the blank may encase any even number of cigarette packs, with half in each half-carton section. However, for purposes of describing the preferred embodiment, this detailed description section will hereinafter describe only a 10-pack dual half-carton configuration.

One half-carton section is defined by the panels or walls having numbers 100 through 195, and the other half-carton section is defined by panels or walls having numbers 200 to 295, with each symmetrical panel or wall in the two half-carton sections designated by numbers that differ by exactly 100.

When the blank of either FIG. 1 or 2, that is, of either embodiment, is folded into a dual half-carton, the top of the cigarette packs will rest along bottom walls 110 and 210. (The cigarette packs are placed into the dual half-carton upside down relative to the orientation of the dual half-carton.) The five cigarette packs that rest on bottom wall 110 are bounded by exterior wall 100, interior wall 120, interior top portion 130, and side walls 165 and 175. Similarly, the five cigarette packs that rest on bottom wall 210 are bounded by exterior wall 200, interior wall 220, interior top portion 230, and side walls 265 and 275. In general, interior walls 120 and 220 abut against each other as do interior top portions 130 and 230.

Attached to exterior walls 100 and 200 are top closures 150 and 250, respectively, which are adapted to first be closed temporarily to allow shipment of the dual half-carton prior to tax stamping, and a second permanently closed position after tax stamping that allows separation into two half-cartons, each having a closed top closure, for sale to consumers. In the preferred embodiments, the top closure contains top portions 160 and 260 and tuck portions 170 and 270. Note that tuck portions 170 and 270 in FIG. 1 differ from those in FIG. 2 in that the left and right edges are tapered at an angle. Tuck portions 170 and 270 in FIG. 2 are generally rectangular, with a slight rounding of the corners.

The tapered edges of tuck portions 170 and 270 in FIG. 1 are designed so that when the top closure of each half-carton section is closed, tuck portions 170 and 270 do not overlap with side wall extension flaps 185, 195 and 285 and 295. Because the embodiment in FIG. 2 does not contain side wall extension flaps, but instead insert side walls 125 and 135, and 225 and 235, there is no potential overlap by tuck portions 170 and 270 when in the permanently closed position. (This is shown in greater detail in FIGS. 9 and 10, which will be discussed below.)

Finally, dust flaps 145, 155 and 245 and 255 are foldably attached to the sides of the bottom walls 110 and 210, and when folded up and permanently glued to the inside of the respective adjacent side wall (165, 175, 265 and 275), add stability and keep dust out of the interior portion of each formed half-carton section.

Figure 3:
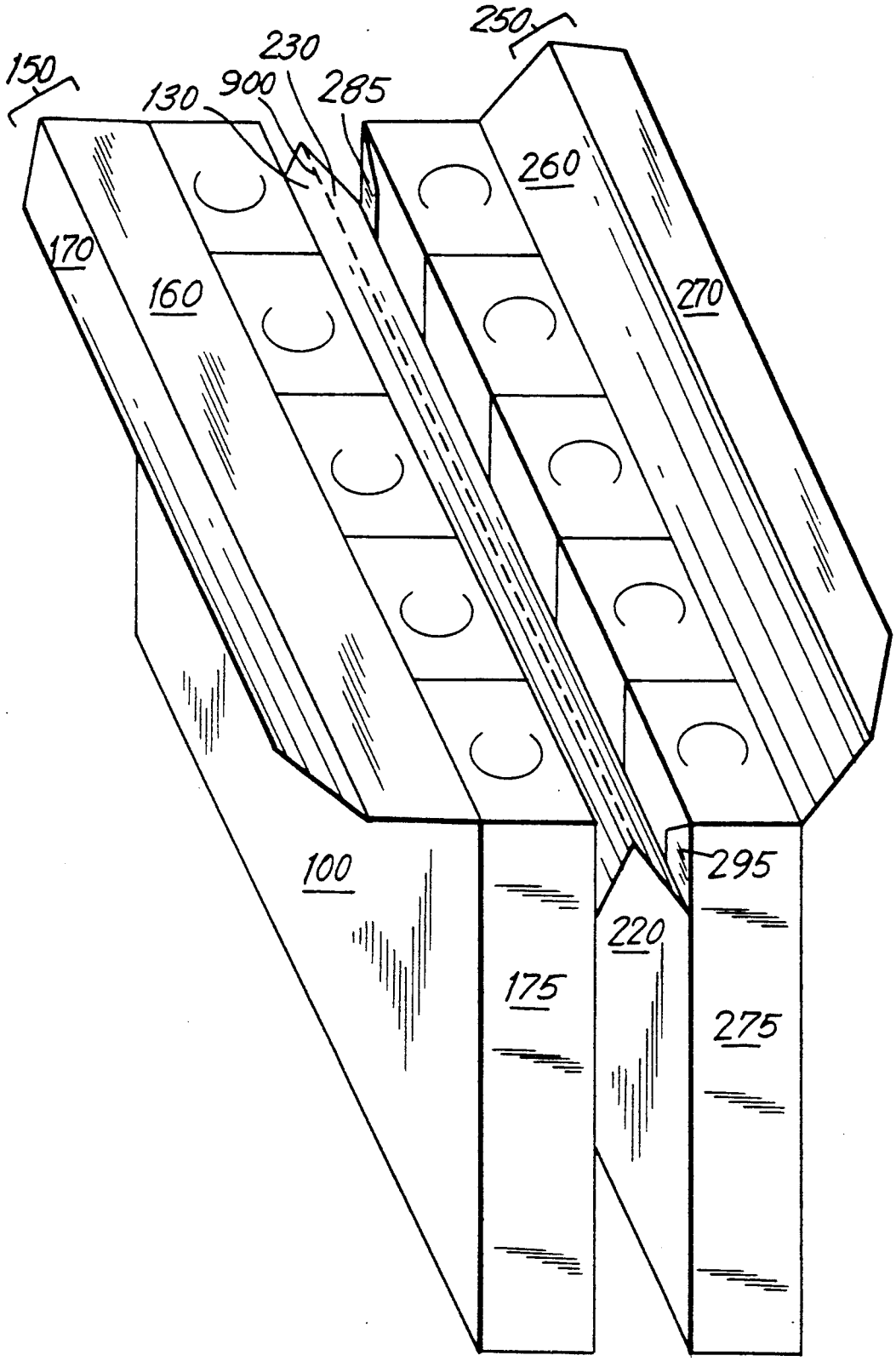
FIG. 3 shows the blank of the first embodiment formed into a dual half-carton configuration containing ten cigarette packs.
Figure 4:
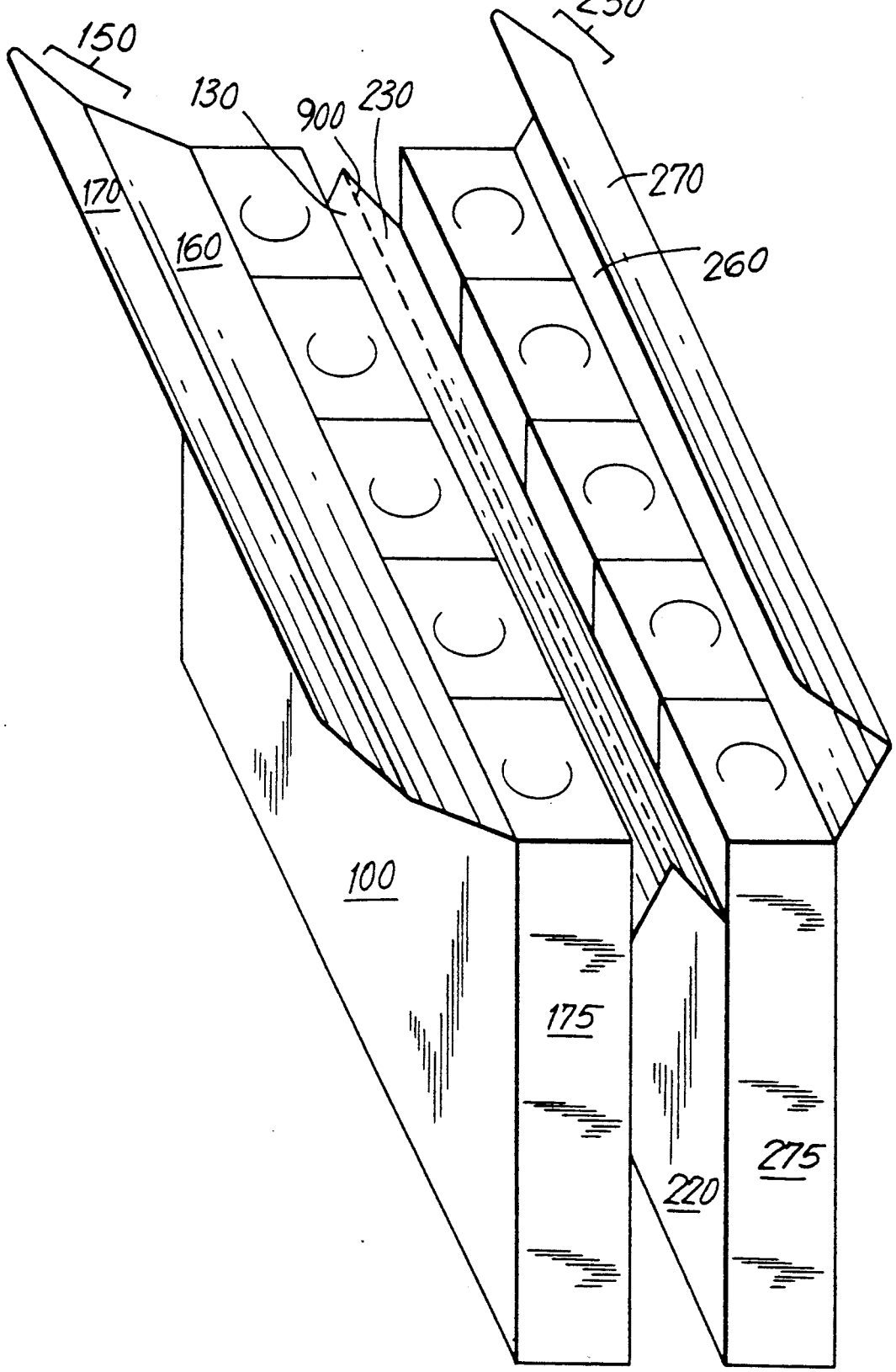
FIG. 4 shows the blank of the second embodiment formed into a dual half-carton configuration containing ten cigarette packs.

FIGS. 3 and 4 show the assembled dual half-carton configurations of the blanks shown in FIGS. 1 and 2, respectively. Exterior walls 100 and 200 are parallel and remote from each other. Interior walls 120 and 220 are parallel and adjacent to each other. The two interior walls 120 and 220 are separated slightly from each other, and interior top portions 130 and 230 are folded along their respective fold lines to form an inverted-V, which is connected along perforated line 900.

This inverted-V position exposes a portion of the walls of the cigarette packs adjacent to the interior walls of the dual half-carton. This facilitates insertion of the cigarette packs into the dual half-carton, and tucking the top closures into each half-carton section, as will be discussed below.

Top closures 150 and 250 are pivotably connected to the top of exterior walls 100 and 200, respectively. Thus the top closures are parallel and remote from each other at the top of the dual half-carton configuration.

Side walls 165 and 175 are parallel and remote from each other on that half-carton section and are perpendicular and attached to each of exterior wall 100, bottom wall 110 and interior wall 120. Similarly, side walls 265 and 275 of the other half-carton section are parallel and remote from each other and perpendicular and attached to exterior wall 200, bottom wall 210 and interior wall 220. Side walls 165 and 175 are foldably connected to exterior wall 100, and side walls 265 and 275 are foldably connected to exterior wall 200.

In the embodiment shown in FIG. 3, side wall extension flap 295, which is foldably attached to side wall 275, is folded around the corner of the cigarette pack adjacent to side wall 275 such that side wall extension flap 295 is perpendicular to side wall 275 and parallel to exterior wall 200. Interior wall 220 is secured permanently to side wall extension flap 295, preferably by glue. Neither glue nor other adhesive means, however, secures the top portion of side wall extension flap 295 to interior top portion 230, so that the dual half-carton may be folded along the fold lines to form the inverted-V position described above.

Similarly, side wall extension flap 285 is foldably attached and perpendicular to side wall 265 and parallel to exterior wall 200, and is secured to interior wall 220, preferably by a permanent glue. Side wall extension flaps 185 and 195 are similarly attached to side wall 165 and 175, respectively, and secured to interior wall 120, preferably by a permanent glue.

Prior to securing the side wall extension flaps to the respective interior walls, dust flaps 145, 155, 245 and 255 are folded up and perpendicular to bottom walls 110 and 210, respectively. Side walls 165, 175, 265 and 275 are then folded around and secured to dust flaps 145, 155, 245 and 255, respectively, preferably by a permanent glue. Then side wall extension flaps 185, 195, 285 and 295 are folded coplanar with and secured to interior walls 120 and 220, respectively.

When side wall extension flaps 185, 195, 285 and 295 are secured to the interior walls 120 and 220 and the dual half-carton is in the inverted-V position, the top portion of side wall extension flaps 185, 195, 285 and 295 are exposed.

In the embodiment shown in FIG. 4, dust flaps 145 and 155 are folded up such that they are perpendicular to bottom wall 110 and parallel and adjacent to the side walls of the two most remote cigarette packs that are enclosed in that half-carton section. Insert side walls 125 and 135, which are pivotably attached to interior wall 120, are folded so they are coplanar with dust flaps 145 and 155, respectively. Next, side walls 165 and 175 are folded along dust flaps 145 and 155, and insert side walls 125 and 135, respectively, and secured thereto, preferably by a permanent glue.

Similarly, dust flaps 245 and 255 are folded up perpendicular to bottom wall 210 and coplanar with insert side walls 225 and 235, respectively, which are pivotably attached to interior wall 220. Side walls 265 and 275 are then folded and secured to dust flaps 245 and 255, and insert side walls 225 and 235, respectively, preferably by a permanent glue.

The edges on each adjacent pair of dust flap and insert side wall (dust flap 145 and insert side wall 125; dust flap 155 and insert side wall 135; dust flap 245 and insert side wall 225; dust flap 255 and insert side wall 235) that meet at the corner of bottom wall 110 and interior wall 120, or bottom wall 210 and interior wall 220, are tapered so that when each pair of dust flap and insert side wall are coplanar they do not overlap.

Insert side walls 125, 135, 225 and 235 are not as tall as side walls 165, 175, 265 and 275, differing by the height of each interior top portion 130 and 230. This allows the dual half-carton to form the inverted-V position described above.

Figure 5:
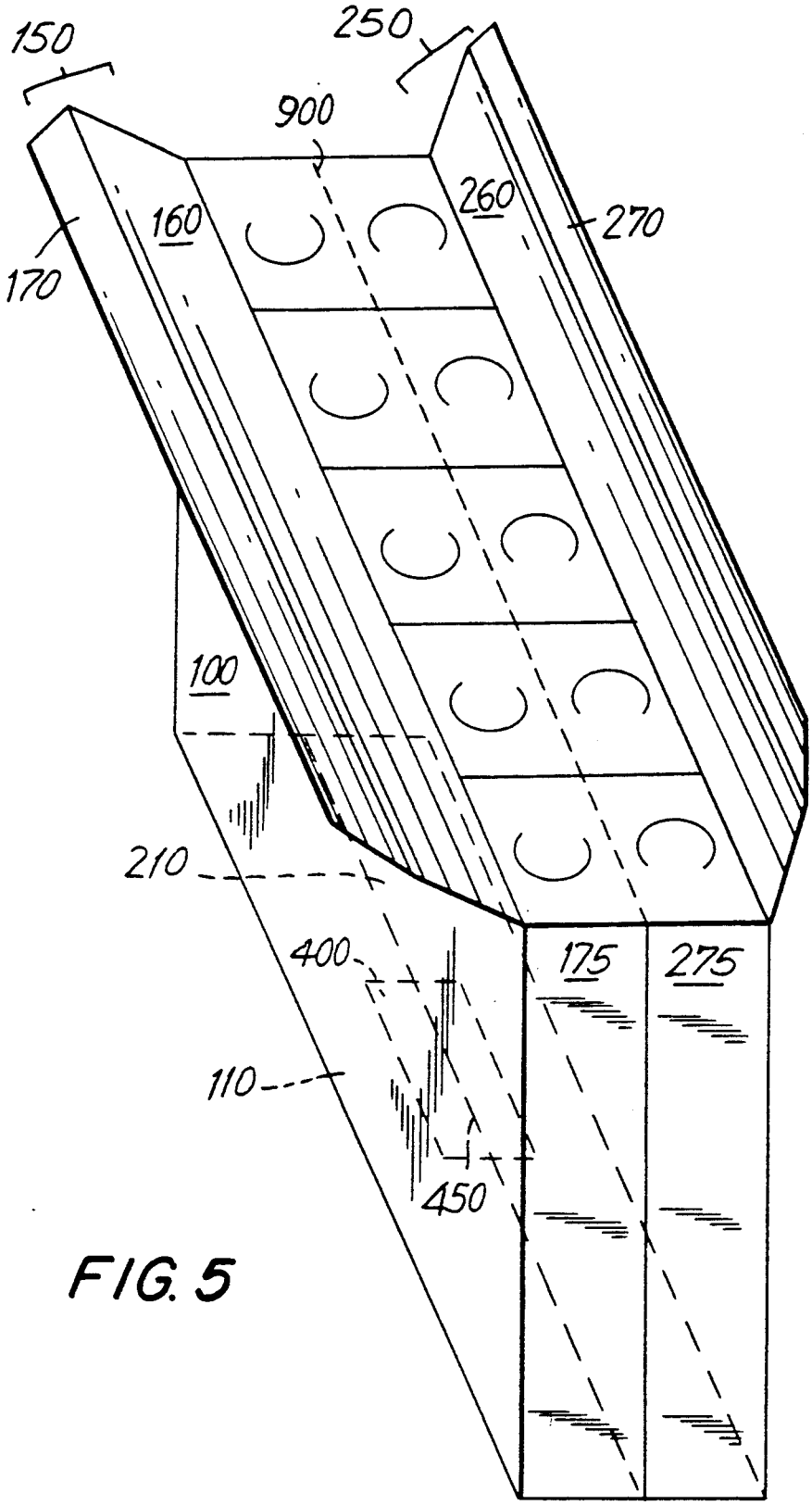
FIG. 5 shows the formed dual half-carton configuration.
Figure 6:
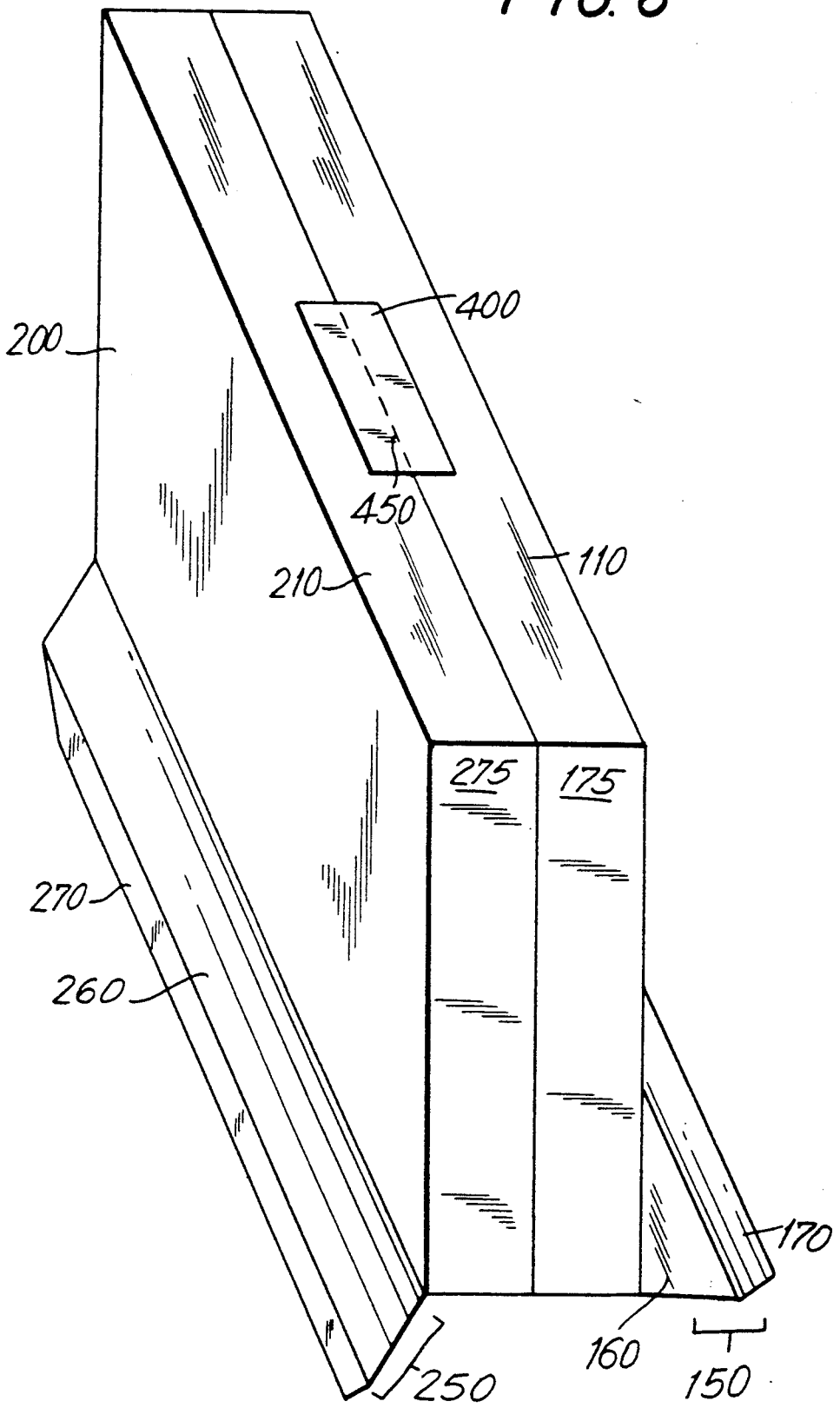
FIG. 6 shows the placement of a piece of perforated tape along the bottom of the dual half-carton configuration.

The embodiments in FIGS. 3 and 4 are then pushed together such that interior walls 120 and 220 are abutted against each other and interior top portions 130 and 230 are coplanar with interior walls 120 and 220, respectively, and abutted against each other, as shown in FIGS. 5 and 6. The dual half-carton is then further secured in this position by detachable securing means applied across bottom walls 110 and 210. The detachable securing means may be tape, an adhesive strip, sticker or any other means for securing the bottom walls that may later be broken or removed.

In the preferred embodiment, the detachable securing means is sticker 400, which is positioned so that perforated line 450 is coplanar with interior walls 120 and 220, as shown in FIG. 6. In this way, the dual half-carton configuration is held securely together, yet may later be separated by tearing or breaking perforated line 450 and perforated line 900.

Sticker 400 may further contain price coding indicia, such as a uniform product code (UPC) label, that extends across perforated line 450 and designates the price of the 10-pack double half-carton. When perforated line 450 is broken, however, the price coding indicia is rendered unreadable by a scanning device. Separate price coding indicia may be placed on interior walls 120 and 220 that designate the price of a 5-pack half-carton. Such price coding indicia would be unreadable unless the dual half-carton is separated.

Figure 7:
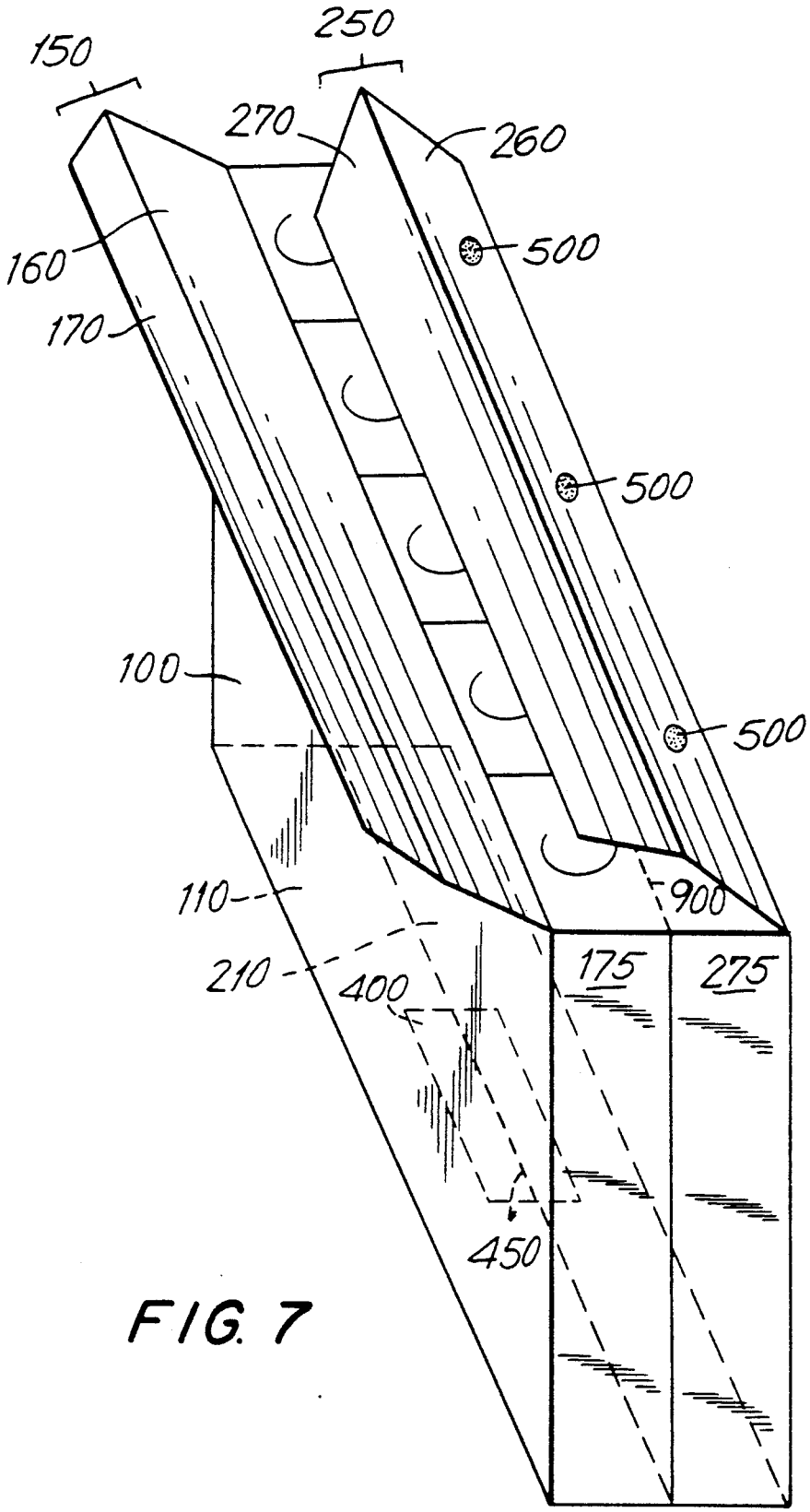
FIG. 7 shows the placement of temporary glue on one top closure flap of the dual half-carton configuration.

After sticker 400 is secured to bottom walls 110 and 210, the top closures are temporarily closed for shipment of the dual half-carton to warehouses and eventually a local tax-stamping facility. As shown in FIG. 7, this may be accomplished by folding top closure 250 across the tops of each half-carton section such that top portion 260 covers the top of the half-carton section to which it is attached, and tuck portion 270 covers the top of the other half-carton section. Temporary glue spots 500 are placed along the exposed surface of top portion 260.

Figure 8:
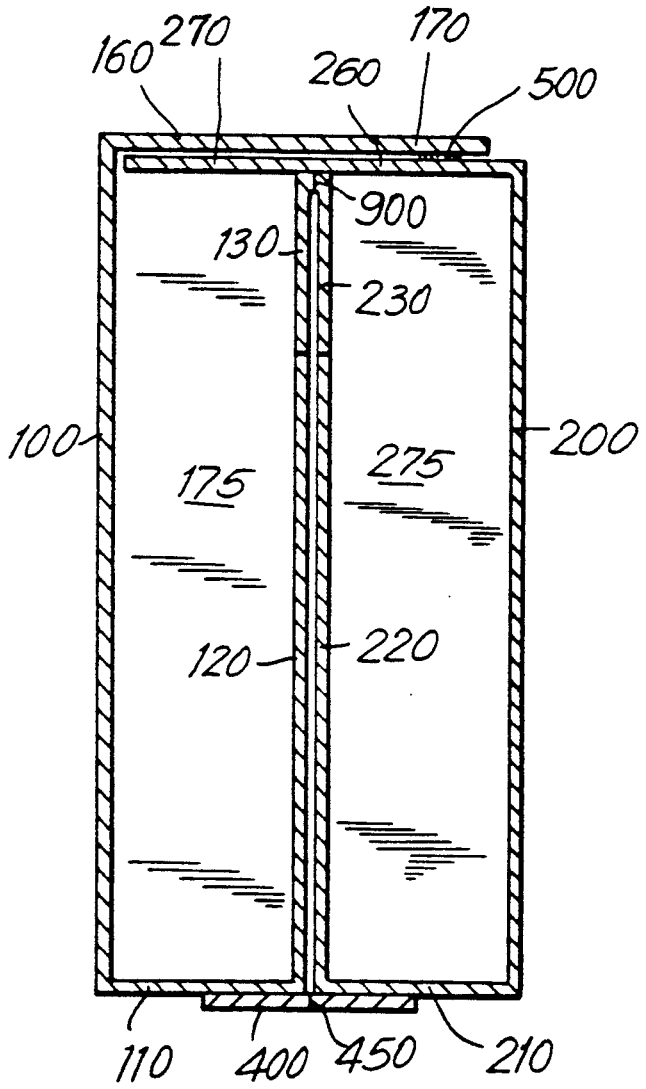
FIG. 8 is a side view with the top closures temporarily glued together for shipment prior to tax stamping.

Top closure 150 is then folded on top of top closure 250, as shown in FIG. 8, such that top portion 160 rests on top of tuck portion 270, and tuck portion 170 rests on top of top portion 260 and is secured by temporary glue spots 500. Alternately, top portion 150 may be closed first to which top portion 250 is glued between top portion 160 and top portion 270.

Those skilled in the art will appreciate that a temporary closure need not require temporary glue spots 500 as shown in FIGS. 7–8, but may be done by other conventional means that are well known in the art.

The temporarily closed dual half-carton may then be sent through a standard tax-stamping machine by conventional automated procedures. Generally, an elongated tapered flap tongue is slid between top closures 150 and 250, breaking apart temporary glue spots 500 without otherwise damaging the integrity of top closures 150 and 250 or the dual half-carton itself. The dual half-carton then appears as shown in FIG. 5.

Top closures 150 and 250 are then folded back parallel to and along the side of exterior walls 100 and 200, respectively, and the dual half-carton is passed through the tax-stamping part of the machine, which places cigarette tax stamps on the bottoms of each of the ten enclosed cigarette packs. (Note that the bottom of the cigarette packs are stamped because the cigarette packs are placed in the dual half-carton upside down relative to the position of the dual half-carton.)

Figure 9:
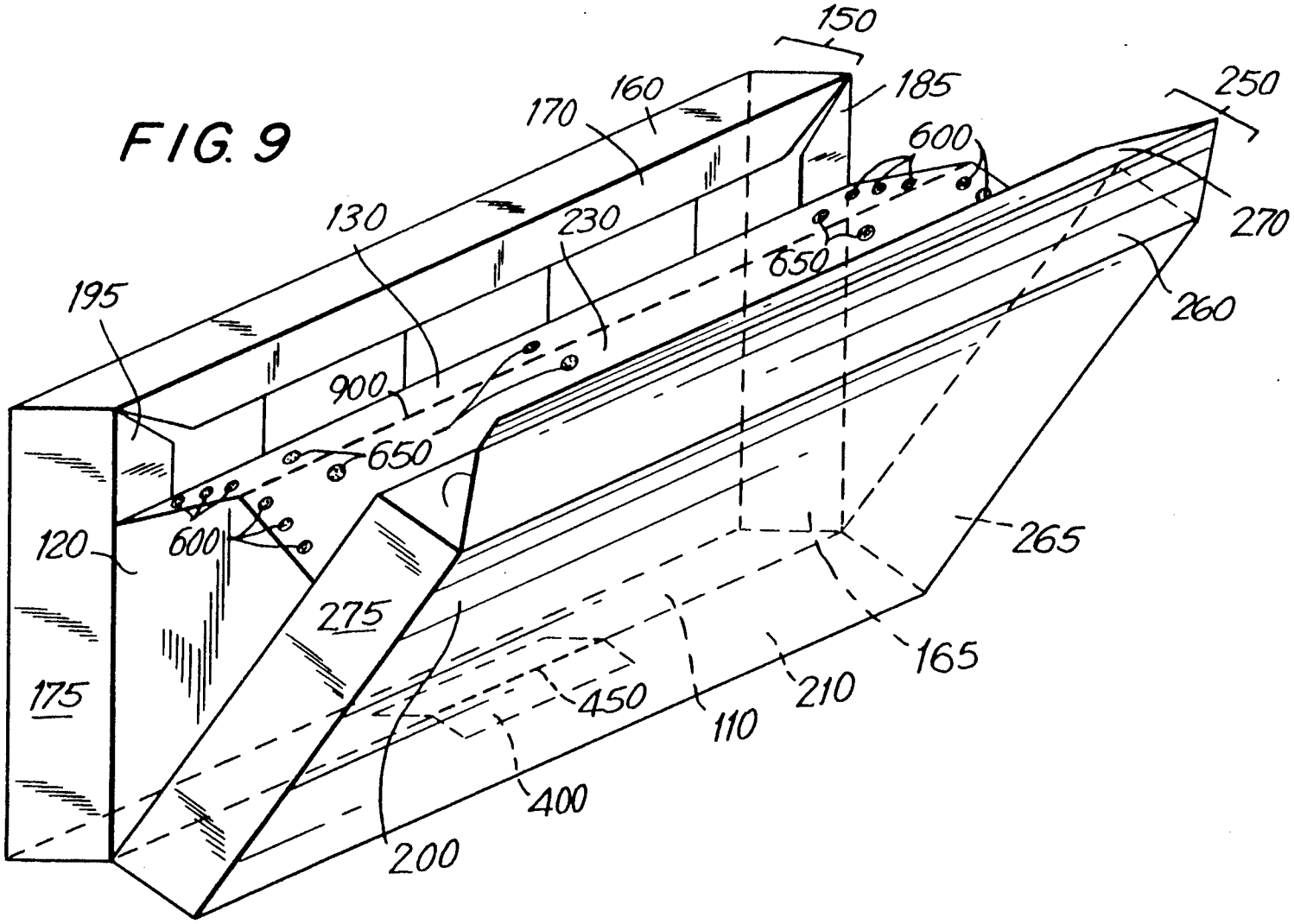
FIG. 9 shows the process of permanently gluing the interior top portion to the side wall extension flaps and permanently closing the top closure of each half-carton section of the first embodiment.
Figure 10:
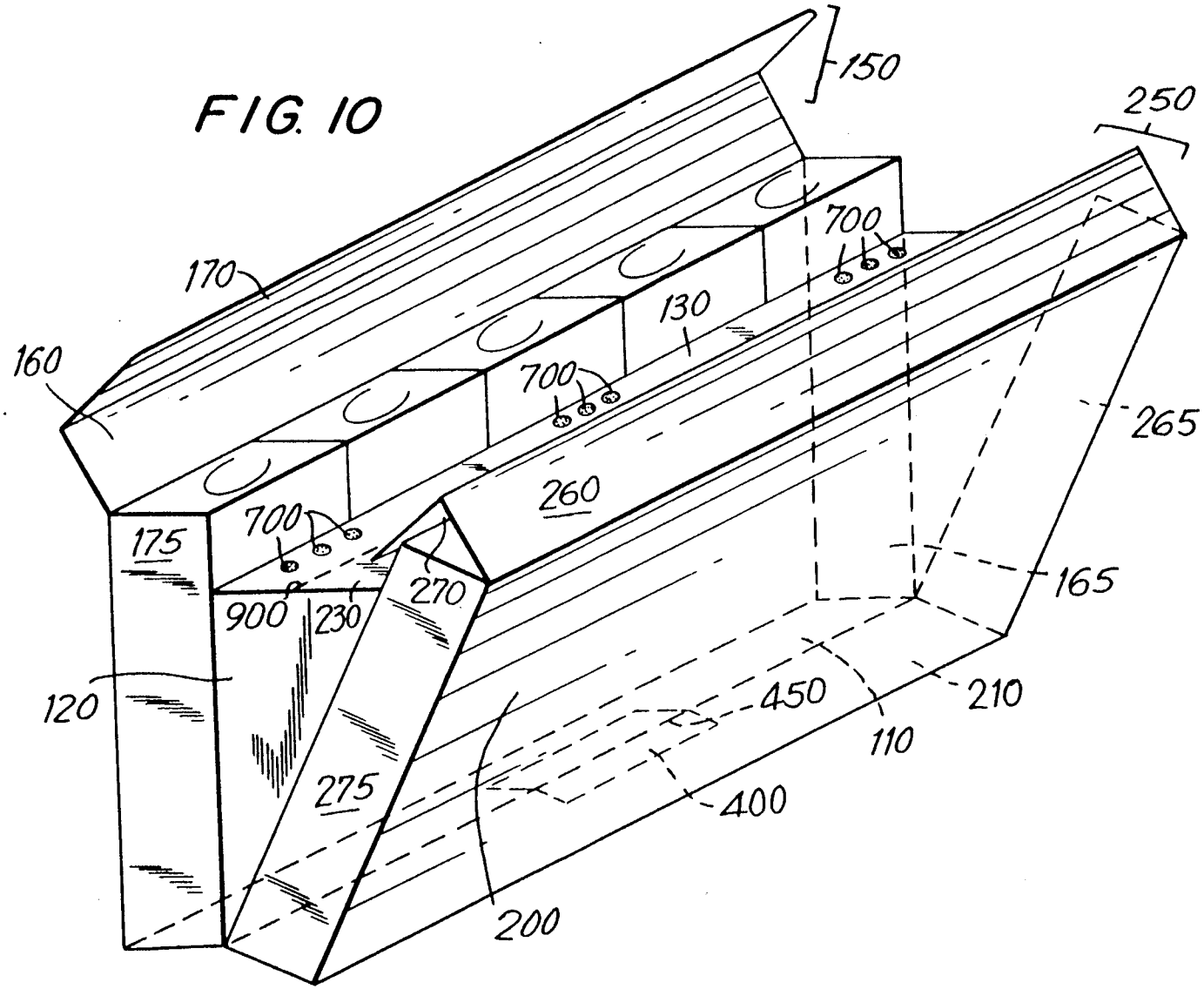
FIG. 10 shows the process of permanently gluing closed the top closure of each half-carton section of the second embodiment.

The dual half-carton is then ready for final closure for shipping to retailers or distribution centers. This step must be done by hand, using special equipment or by modifying the standard tax-stamping machine as they exist at the time this application was filed. As shown in FIGS. 9 and 10, the two half-carton sections are separated slightly, pivoting along the axis defined by perforated line 450 and the boundary between bottom walls 110 and 210. Interior top portions 130 and 230 remain connected along perforated line 900, and are folded at the fold lines between interior wall 120 and interior top portion 130, and interior wall 220 and interior top portion 230.

In the first embodiment shown in FIG. 9, top closure 150 is folded around the bottom of the five cigarette packs in that half-carton section such that top portion 160 is parallel and remote to bottom wall 110 and tuck portion 170 is perpendicular to top portion 160 and coplanar with interior wall 120.

The angled or tapered sides of tuck portion 170 in this embodiment are designed so that they do not overlap with the angled or tapered top portion of side wall extension flaps 185 and 195. In other words, the sum of the angles of the corners of tuck portion 170 and side wall extension flap 185 that radiate out from the point at which top wall 160, side wall 165 and tuck portion 170 meet is less than or equal to 90°. Similarly, the sum of the angles of the corners of tuck portion 170 and side wall extension flap 195 that radiate out from the point at which top wall 160, side wall 175 and tuck portion 170 meet is less than or equal to 90°.

Top closure 250 is folded such that top wall 260 rests on the bottom of cigarette packs encased in that half-carton section, and is parallel to and remote from bottom wall 210. Tuck portion 270 is folded downward and perpendicular to top portion 260 such that it is coplanar with interior wall 220.

The tapered or angled sides of tuck portion 270 are symmetrical to tuck portion 170, and are similarly positioned relative to side wall extension flaps 285 and 295 such that there is no overlap. Again, the sum of the angles of each of the two corners at which tuck portion 270 meets with side wall extension flaps 285 and 295 when added to the angle of side wall extension flaps 285 and 295, respectively, is each less than or equal to 90°. While not shown in FIG. 9, the relative positioning of side wall extension flaps 285 and 295 and tuck portion 270 is the same as the relative positioning of side wall extension flaps 185 and 195 and tuck portion 170. Note that in the preferred embodiment, there is symmetry of each half-carton section along the plane defined by perforated line 450 and perforated line 900.

After top closures 150 and 250 are in the above-mentioned position, interior top portion 130 is folded along the fold line into plane with interior wall 120 and secured in place. Preferably, this is accomplished by placing permanent glue spots 600 along the edges of interior top portion 130 adjacent to side insert walls 185 and 195 so that when top interior portion 130 is moved into plane With interior wall 120 permanent glue spots 600 adhere to side wall extension flaps 185 and 195, but not to tuck portion 170.

Similarly, permanent glue spots 600 are placed along the sides of interior top portion 230 so that when interior top portion 230 is folded along the fold line into plane with interior wall 220, permanent glue spots 600 adhere to side wall extension flaps 285 and 295, but not to tuck portion 270.

In addition, top closures 150 and 250 optionally may be further secured in place by the addition of releasable glue spots 650 placed along interior top portions 130 and 230 near perforated line 900. The positioning of releasable glue spots 650 is such that when interior top portions 130 and 230 are folded coplanar with interior walls 120 and 220, respectively, releasable glue spots 650 become affixed to tuck portions 170 and 270, respectively. Unlike permanent glue spots 600, releasable glue spots 650 release with a moderate amount of force without tearing the paperboard. The placement and type of glue or other adhesive means will be obvious to those skilled in the art.

Thus when completed, the dual half-carton is of the same size and shape as a standard 2×5-carton. However, as shown in FIG. 11, the dual half-carton may be separated by tearing perforated line 900 and perforated line 450. Each resulting half-carton is fully enclosed, with the tuck portion inserted inside the interior top portion.

If releasable glue spots 650 are omitted from the first embodiment described in FIG. 9, top closure 150 may be readily opened to expose the bottom of the cigarette pack encased in that half-carton section, as tuck portion 170 is neither glued nor otherwise secured to interior top portion 130. Similarly, top closure 250 may be readily opened to expose the bottom of the five cigarette packs in case in that half-carton section, as tuck portion 270 is neither glued nor otherwise secured to interior top portion 230. With the optional releasable glue spots 650 shown in FIG. 9, top closures 150 and 250 may be opened by applying sufficient force to break releasable glue spots 650, after which the top closures and the half-carton sections are the same as if releasable glue spots 650 were not used.

In the second embodiment shown in FIG. 10, top closure 150 is wrapped around the five cigarette packs in that half-carton section such that top wall 160 rests on the bottom of the cigarette packs in its half-carton section parallel to and remote from bottom wall 110. Tuck portion 170 is folded downward and perpendicular to top wall 170 such that it is coplanar with interior wall 120. Similarly, top closure 250 is folded such that top wall 260 rests on the bottom of the five cigarette packs encased in that half-carton section and is parallel to and remote from bottom wall 210. Tuck portion 270 is folded downward and perpendicular to top wall 260 and coplanar with interior wall 220. (The resultant positioning of top closures 150 and 250 are the same as shown and described in the embodiment of FIG. 9.)

Releasable glue spots 700 are placed on the interior side of interior top portion 130 along a horizontal line running from side walls 165 to 175. This may be done prior to, concurrently, or after top closure 150 is folded closed as described above.

Similarly, releasable glue spots (not shown) are placed along the interior portion of interior top portion 230 running from side walls 265 to 275.

After top closures 150 and 250 are in the above-mentioned closed position, and releasable glue spots 700 and the releasable glue spots (not shown) along interior top portion 230 are applied, interior top portions 130 and 230 are folded along their respective fold lines into plane with interior walls 120 and 220, respectively, such that releasable glue spots 700 secure interior top portion 130 to tuck portion 170, and the releasable glue spots (not shown) on interior top portion 230 secure interior top portion 230 to tuck portion 270.

Alternately, releasable glue spots 700 may instead be applied to tuck portion 170, and the releasable glue spots (not shown) along interior top portion 230 may be instead applied to tuck portion 270. The placement and type of glue or other adhesive means will be obvious to those skilled in the art.

After interior top portions 130 and 230 are secured to tuck portions 170 and 270, the dual half-carton is ready for final shipment to retailers. The dual half-carton may then either be sold as one 2×5 unit, similar to standard 2×5 cigarette cartons, or may be separated and sold as individual half-cartons containing five cigarette packs each.

FIG. 11 shows the dual half-carton after separation into two half-carton units. Perforated lines 900 and 400 are torn apart, leaving two substantially identical half-cartons for sale to consumers. Alternately, a consumer may purchase a dual half-carton unit and separate it into two half-cartons after purchase.

The second embodiment shown in FIG. 10 does not allow the top closure of each half-carton to be readily opened because tuck portions 170 and 270 are glued or otherwise secured to interior top portions 130 and 230, respectively. However, this property gives added security from preventing the top closures from inadvertently opening during final shipment or prior to use by consumers. This is similar to the version of the first embodiment of FIG. 9 in which the optional releasable glue spots 650 are included.

In the preferred embodiments, the cigarette packs in each half-carton section are positioned so that when the half-carton section is separated the brand name, label or logo is readable by a consumer when the interior wall is toward the consumer and the top closure is opened away from the consumer. This is illustrated in FIGS. 3, 4 and 6 by the letter "C" on each cigarette pack. Note that the relative position of the five cigarette packs in each half-carton section are inverted relative to those in the other half-carton section.

It will be apparent that minor modifications may be made to the manner in which the dual half-cartons are fabricated, temporarily closed, opened for tax-stamping, closed for shipment to retailers, or separated into half-cartons for sale to consumers.

For example, the size and shape of the tuck portions of the top closures may be changed. And the size and shape of the side wall extension flaps in the first embodiment or the insert side walls in the second embodiment may be changed. Any such changes to the top closures and side wall extension flaps or insert side walls should be consistent such that the interior top portion may be folded out of plane from the interior wall to which it is attached, and in the first embodiment such that the tuck portion does not overlap with the side wall extension flap.

In addition, the dust flaps may be omitted, or changed in size and shape and the length of the dual half-carton, running between the side walls, may be increased or decreased to permit each half-carton section to encase more than or less than five cigarette packs.

For purposes of clarity, the terms used in the specification and in the following claims, such as top, bottom, interior, exterior and side, are used solely to provide the reader with a reference for relative positions of the various walls or panels, and in no way limits the use of this invention nor the scope of the claims. For example, the "bottom wall" of a half-carton section need not be used as the bottom of the box.

One skilled in the art will appreciate that the present invention can be practiced by other than the described embodiments, which are presented for purposes of illustration and not of limitation, and the present invention is limited only by the claims that follow.

We claim:

1. A detachable double half-carton for encasing a plurality of cigarette packs comprising a first and second half-carton, each half-carton comprising:

a bottom wall;

an exterior wall perpendicularly attached to the bottom wall;

a top closure pivotably attached to the exterior wall opposite from the bottom wall;

an interior wall perpendicularly attached to the bottom wall opposite the exterior wall; and an interior top portion foldably attached to the interior wall along a fold line opposite the bottom wall such that when the interior wall and the interior top portion are coplanar they are substantially the same size and shape as the exterior wall, the interior top portion bounded at its ends thereby by two edges that are perpendicular to the fold line, and such that the two edges of the interior top portion that are perpendicular to the fold line are free from attachment to any portion of the double half-carton so that the interior top portion may be folded along the fold line out of plane with the interior wall while the interior top portion remains planar; wherein:

the two half-cartons are detachably attached along the edge of each interior top portion that is opposite from each respective bottom wall.

2. The detachable double half-carton according to claim 1 wherein the detachable double half-carton is made from one blank comprising paperboard.

3. The detachable double half-carton according to claim 2 wherein each top closure further comprises:

a top portion pivotably attached to the exterior wall and of substantially the same size as the bottom wall; and a tuck portion pivotably attached to the top portion along the edge opposite from the exterior wall; wherein:

the top closures are capable of being positioned in:

(a) a first position in which the top and tuck portions are folded back along the outside of the exterior wall, exposing the top area of the cigarette packs encased by the half-carton;

(b) a second position in which the top portion of the first half-carton is folded over and encloses the top area of the cigarette packs encased by the first half-carton and the tuck portion of the first half-carton extends across the top area of the cigarette packs encased by the second half-carton, and in which the top portion of the second half-carton is folded over along the top of the tuck portion of the first half-carton and the tuck portion of the second half-carton is folded over along the top of the top portion of the first half-carton; and (c) a third position in which the top portions are folded over and enclose the top area of the cigarette packs encased by the half-carton to which the top closure is attached, and the tuck portions are tucked into the area between the interior top portion and the cigarette packs encased by the half-carton to which the tuck portion is attached.

4. The detachable double half-carton according to claim 3 wherein the double half-carton further comprises securing means for detachably attaching the bottom wall of each half-carton to the bottom wall of the other half-carton such that the bottom walls are substantially coplanar and adjacent to each other, the securing means including a pivot line along which the two half-cartons may be pivoted so that the edge of one interior wall that is foldably attached to its respective bottom wall remains substantially adjacent to the corresponding edge of the other interior wall while the respective remainders of the interior walls are separated from each other.

5. The detachable double half-carton according to claim 4 wherein the securing means is a perforated sticker positioned such that the perforation line of the perforated sticker runs parallel to and along the line defined by the edge that connects the bottom and interior walls of each half-carton.

6. The detachable double half-carton according to claim 5 wherein the perforated sticker further comprises price coding indicia such that if the perforation is broken, the price coding indicia is separated such that it is not readable.

7. The detachable double half-carton according to claim 4 wherein each half-carton further comprises two side walls, and in which each side wall comprises:

a first edge foldably attached to one edge of the exterior wall; and a second edge parallel to and opposite from the first edge, the second edge being secured along one edge of the interior wall.

8. The detachable double half-carton according to claim 7 wherein each side wall of each half-carton further comprises a side wall extension flap foldably attached to the second edge of each side wall and secured to the inside of the interior wall.

9. The detachable double half-carton according to claim 8 wherein when the top closure is in the third position, the tuck portion of each half-carton extends between the nearest two edges of each side wall extension flap of that half-carton.

10. The detachable double half-carton according to claim 9 wherein the interior top portion of each half-carton is folded such that it is substantially coplanar with the interior wall to which it is attached and is secured to the adjacent portion of the side wall extension flaps of that half-carton.

11. The detachable double half-carton according to claim 10 wherein when the top closure is in the third position, the tuck portion of each half-carton is secured to the inside of the interior top portion of that half-carton.

12. The detachable double half-carton according to claim 11 wherein each half-carton further comprises two dust flaps foldably attached to the bottom wall adjacent to each side wall.

13. The detachable double half-carton according to claim 7 wherein each half-carton further comprises insert side walls foldably attached to each side of the interior wall, each insert side wall being secured to the inside of the adjacent side wall.

14. The detachable double half-carton according to claim 13 wherein when the top closure is in the third position, the interior wall and interior top portion of each half-carton is coplanar, and the tuck portion of each half-carton is secured to the inside of the interior top portion.

15. The detachable double half-carton according to claim 14 wherein each half-carton further comprises two dust flaps foldably attached to the bottom wall adjacent to each side wall.

16. A blank for forming a detachable double half-carton for encasing a plurality of cigarette packs, comprising:

a first top closure panel;

a first exterior wall panel foldably attached to the first top closure panel;

a first bottom wall panel foldably attached to the first exterior wall panel opposite from the first top closure panel;

a first interior wall panel foldably attached to the first bottom wall panel opposite from the first exterior wall panel;

a first interior top portion panel foldably attached to the first interior wall panel along a first fold line opposite from the first bottom wall panel, the first interior top portion panel bounded at its ends thereby by two edges that are perpendicular to the first fold line such that the two edges of the first interior top portion panel that are perpendicular to the first fold line are free from attachment to any portion of the blank so that the first interior top portion panel may be folded along the first fold line out of plane with the first interior wall panel while the first interior top portion panel remains planar;

a second interior top portion panel foldably and detachably attached to the first interior top portion panel opposite the first interior wall panel;

a second interior wall panel foldably attached to the second interior top portion panel along a second fold line opposite from the first interior top portion panel, the second interior top portion panel bounded at its ends thereby by two edges that are perpendicular to the second fold line such that the two edges of the second interior top portion panel that are perpendicular to the second fold line are free from attachment to any portion of the blank so that the second interior top portion panel may be folded along the second fold line out of plane with the second interior wall panel while the second interior top portion panel remains planar;

a second bottom wall panel foldably attached to the second interior wall panel opposite from the second interior top portion panel;

a second exterior wall panel foldably attached to the second bottom wall panel opposite from the second interior wall panel; and a second top closure panel foldably attached to the second exterior wall panel opposite from the second bottom wall panel; wherein:

the first interior wall panel and first interior top portion panel are of substantially the same size and shape as the first exterior wall panel when the first interior wall panel and the first interior top portion panel are coplanar; and wherein:

the second interior wall panel and second interior top portion panel are of substantially the same size and shape as the second exterior wall panel when the second interior wall panel and the second interior top portion panel are coplanar.

17. The blank according to claim 16 wherein the double half-carton further comprises:

a left first side wall element for connecting the left side of the first exterior wall panel, the left side of the first bottom wall panel and the left side of the first interior wall panel when the blank is formed into a double half-carton;

a right first side wall element for connecting the right side of the first exterior wall panel, the right side of the first bottom wall panel and the right side of the first interior wall panel when the blank is formed into a double half-carton;

a left second side wall element for connecting the left side of the second exterior wall panel, the left side of the second bottom wall panel and the left side of the second interior wall panel when the blank is formed into a double half-carton; and a right second side wall element for connecting the right side of the second exterior wall panel, the right side of the second bottom wall panel and the right side of the second interior wall panel when the blank is formed into a double half-carton.

18. The blank according to claim 17 wherein the left first side wall element further comprises:

a left first side wall panel foldably attached to the left side of the first exterior wall panel such that the left first side wall panel is perpendicular to the first exterior wall panel, the first interior wall panel and the first bottom wall panel when the blank is formed into a double half-carton; and a left first side wall extension flap panel foldably attached to the left first side wall panel opposite from the first exterior wall panel; wherein the right first side wall element further comprises:

a right first side wall panel foldably attached to the right side of the first exterior wall panel such that the right first side wall panel is parallel to and substantially the same size and shape as the left first side wall panel when the blank is formed into a double half-carton; and a right first side wall extension flap panel foldably attached to the right first side wall panel opposite from the first exterior wall panel; wherein the left second side wall element further comprises:

a left second side wall panel foldably attached to the left side of the second exterior wall panel such that the left second side wall panel is perpendicular to the second exterior wall panel, the second interior wall panel and the second bottom wall panel when the blank is formed into a double half-carton; and a left second side wall extension flap panel foldably attached to the left second side wall panel opposite from the second exterior wall panel; and wherein the right second side wall element further comprises:

a right second side wall panel foldably attached to the right side of the second exterior wall panel such that the right second side wall panel is parallel to and substantially the same size and shape as the left second side wall panel when the blank is formed into a double half-carton; and a right second side wall extension flap panel foldably attached to the right second side wall panel opposite from the first exterior wall panel.

19. The blank according to claim 18 wherein the first and second top closure panels further comprise:

a first top wall panel of the first top closure panel foldably attached to the first exterior wall panel and substantially the same size and shape as the first bottom wall panel;

a first tuck portion panel of the first top closure panel foldably attached to the first top wall panel opposite from the first exterior wall panel;

a second top wall panel of the second top closure panel foldably attached to the second exterior wall panel and substantially the same size and shape as the second bottom wall panel; and a second tuck portion panel of the second top closure panel foldably attached to the second top wall panel opposite from the second exterior wall panel.

20. The blank according to claim 19 wherein the double half-carton further comprises:

a left first dust flap panel foldably attached to the first bottom wall panel adjacent to the left first side wall panel;

a right first dust flap panel foldably attached to the first bottom wall panel opposite from the left first dust flap panel;

a left second dust flap panel foldably attached to the second bottom wall panel adjacent to the left second side wall panel; and a right second dust flap panel foldably attached to the second bottom wall panel opposite from the left second dust flap panel.

21. The blank according to claim 17 wherein the left first side wall element further comprises:

a left first side wall panel foldably attached to the left side of the first exterior wall panel such that the left first side wall panel is perpendicular to the first exterior wall panel, the first interior wall panel and the first bottom wall panel when the blank is formed into a double half-carton; and a left first insert side wall panel adjacent to the left first side wall panel and foldably attached to the first interior wall panel; wherein the right first side wall element further comprises:

a right first side wall panel foldably attached to the right side of the first exterior wall panel such that the right first side wall panel is parallel to and substantially the same size and shape as the left first side wall panel when the blank is formed into a double half-carton; and a right first insert side wall panel adjacent to the right first side wall panel and foldably attached to the first interior wall panel; wherein the left second side wall element further comprises:

a left second side wall panel foldably attached to the left side of the second exterior wall panel such that the left second side wall panel is perpendicular to the second exterior wall panel, the second interior wall panel and the second bottom wall panel when the blank is formed into a double half-carton; and a left second insert side wall panel adjacent to the left second side wall panel and foldably attached to the second interior wall panel; and wherein the right second side wall element further comprises:

a right second side wall panel foldably attached to the right side of the second exterior wall panel such that the right second side wall panel is parallel to and substantially the same size and shape as the left second side wall panel when the blank is formed into a double half-carton; and a right second insert side wall panel adjacent to the right second side wall panel and foldably attached to the second interior wall panel.

22. The blank according to claim 21 wherein the first and second top closure panels further comprise:

a first top wall panel of the first top closure panel foldably attached to the first exterior wall panel and substantially the same size and shape as the first bottom wall panel;

a first tuck portion panel of the first top closure panel foldably attached to the first top wall panel opposite from the first exterior wall panel;

a second top wall panel of the second top closure panel foldably attached to the second exterior wall panel and substantially the same size and shape as the second bottom wall panel; and a second tuck portion panel of the second top closure panel foldably attached to the second top wall panel opposite from the second exterior wall panel.

23. The blank according to claim 22 wherein the double half-carton further comprises:

a left first dust flap panel foldably attached to the first bottom wall panel adjacent to the left first side wall panel;

a right first dust flap panel foldably attached to the first bottom wall panel opposite from the left first dust flap panel;

a left second dust flap panel foldably attached to the second bottom wall panel adjacent to the left second side wall panel; and a right second dust flap panel foldably attached to the second bottom wall panel opposite from the left second dust flap panel.

24. A detachable double half-carton for encasing a plurality of cigarette packs comprising two half-cartons in which each half-carton has a bottom wall, an interior wall foldably attached to the bottom wall, an exterior wall foldably attached to the bottom wall opposite the interior wall, two side walls that connect the interior and exterior walls, and a truck flap foldably attached to the exterior wall opposite the bottom wall, wherein:

the interior wall of each half-carton further comprises an interior top portion that is foldably attached to the remainder of the interior wall along a linear fold line that runs across the interior wall from side wall to side wall, the remainder of the interior wall and the interior top portion of each half-carton being substantially the same size and shape as each exterior wall;

the interior walls of the half-cartons are detachably attached to each other along a line along a top edge of each interior top portion parallel to and opposite the respective fold lines; and the interior wall of each half-carton is perpendicularly connected to each respective side wall only along the portion on the side of the respective linear fold line opposite the line along the top edge of each interior half-carton, leaving the interior top portion of each half-carton unconnected to each respective side wall and thus free to pivot along its respective linear fold line out of plane with the remainder of the respective interior wall.

* * * * *